US008858157B2

(12) United States Patent
Welschinger et al.

(10) Patent No.: US 8,858,157 B2
(45) Date of Patent: Oct. 14, 2014

(54) CENTRIFUGAL PUMP HAVING AN APPARATUS FOR THE REMOVAL OF PARTICLES

(75) Inventors: Thomas Welschinger, Radolfzell (DE); Antonio Morisco, Winterthur (CH); Nicolas Martin, Winterthur (CH)

(73) Assignee: Sulzer Pumpen AG, Winterthur (CH)

( * ) Notice: Subject to any disclaimer, the term of this patent is extended or adjusted under 35 U.S.C. 154(b) by 522 days.

(21) Appl. No.: 13/131,791

(22) PCT Filed: Dec. 21, 2009

(86) PCT No.: PCT/EP2009/067619
§ 371 (c)(1), (2), (4) Date: May 27, 2011

(87) PCT Pub. No.: WO2010/079088
PCT Pub. Date: Jul. 15, 2010

(65) Prior Publication Data

US 2011/0229308 A1 Sep. 22, 2011

(30) Foreign Application Priority Data

Jan. 9, 2009 (EP) ..... 09150312

(51) Int. Cl.
*F04D 7/04* (2006.01)
*F04D 29/18* (2006.01)

(52) U.S. Cl.
CPC ..... *F04D 7/04* (2013.01); *F04D 29/185* (2013.01)
USPC ..... 415/58.4

(58) Field of Classification Search
CPC ..... F04D 7/04; F04D 29/185; F01D 25/32
USPC ..... 415/56.4, 56.5, 57.1, 57.3, 121.2, 415/169.1, 169.2
See application file for complete search history.

(56) References Cited

U.S. PATENT DOCUMENTS

| | | | | | |
|---|---|---|---|---|---|
| 1,385,115 | A | * | 7/1921 | Cone | 415/58.1 |
| 1,541,171 | A | * | 6/1925 | Noble | 415/100 |
| 1,979,621 | A | * | 11/1934 | Hollander | 415/116 |
| 3,257,957 | A | * | 6/1966 | Tracy | 415/112 |
| 3,438,330 | A | * | 4/1969 | Evans | 415/119 |

(Continued)

FOREIGN PATENT DOCUMENTS

| | | | |
|---|---|---|---|
| GB | 20561 | A | 0/1910 |
| GB | 1040416 | A | 8/1966 |
| WO | WO 2005/038260 | A1 | 4/2005 |
| WO | WO 2008/128681 | A1 | 10/2008 |

*Primary Examiner* — Edward Look
*Assistant Examiner* — Eldon Brockman
(74) *Attorney, Agent, or Firm* — Kilpatrick Townsend & Stockton LLP

(57) ABSTRACT

A centrifugal pump (1, 110) includes an apparatus for the removal of particles, wherein the centrifugal pump includes an impeller (6, 106). A fluid (2, 102) can be conveyed by means of the impeller (6, 106) through a suction passage (5, 105) from a suction stub (3, 103) to a pressure stub (4, 104). The impeller (6, 106) is rotatable in a stator (7, 107). A gap (9, 19, 109) is arranged between the stator (7, 107) and the impeller (6, 106), wherein the gap (9, 19, 109) opens into a storage space (11, 21, 111) for particles. The storage space (11, 21, 111) communicates with the suction passage (5, 105) via a return line (12, 112) running through the stator (7, 107).

17 Claims, 8 Drawing Sheets

(56) References Cited

U.S. PATENT DOCUMENTS

Figure 1:
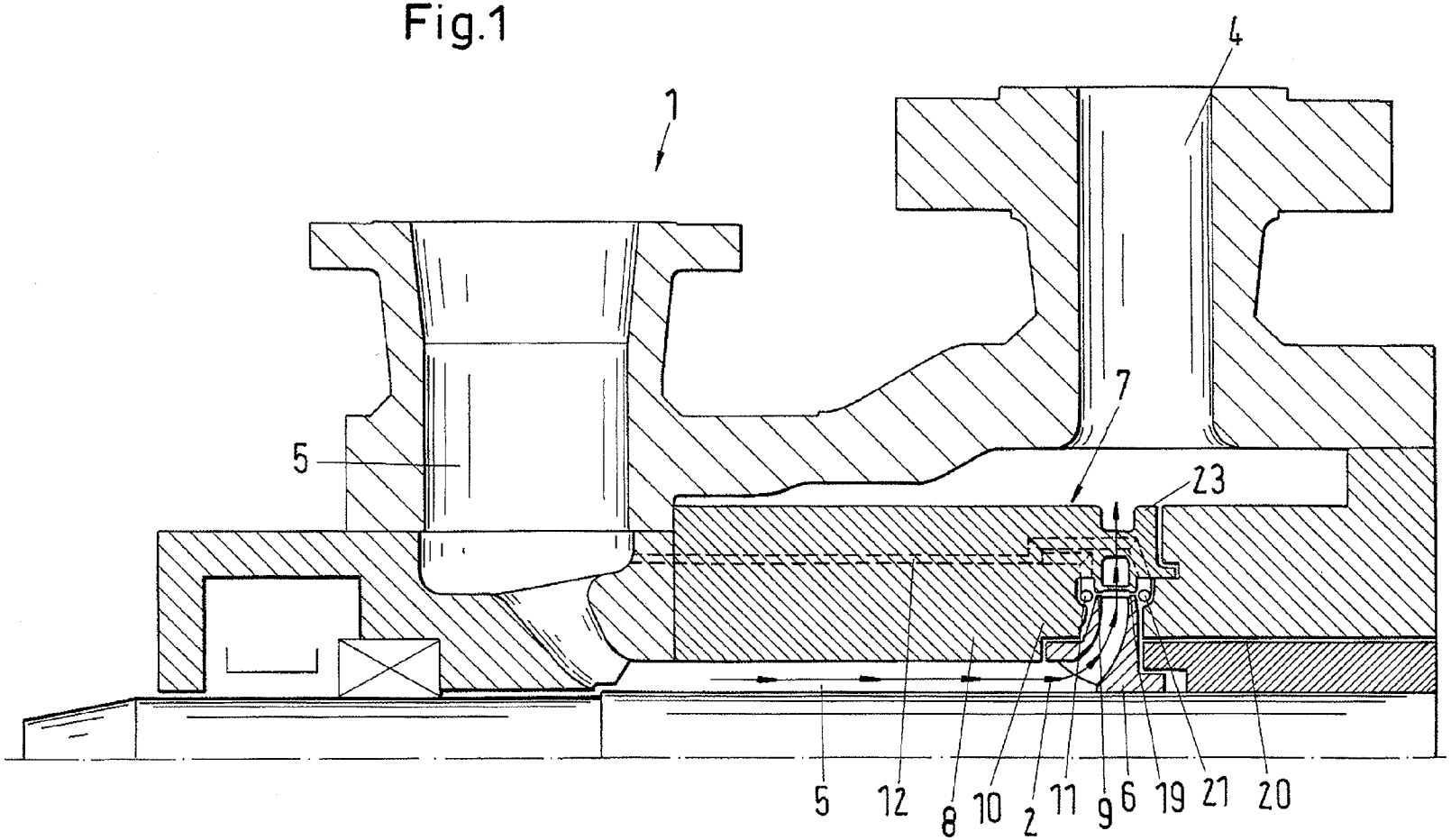

| | | | | | |
|---|---|---|---|---|---|
| 4,086,020 | A * | 4/1978 | Tanabe et al. | 415/106 |
| 4,170,435 | A * | 10/1979 | Swearingen | 415/1 |
| 4,645,433 | A * | 2/1987 | Hauenstein | 417/420 |
| 5,385,442 | A * | 1/1995 | Lehe et al. | 415/104 |
| 5,427,498 | A * | 6/1995 | Lehe et al. | 415/58.2 |
| 5,445,494 | A * | 8/1995 | Hanson | 415/107 |
| 5,827,040 | A * | 10/1998 | Bosley et al. | 415/106 |
| 5,984,628 | A * | 11/1999 | Gray et al. | 415/169.4 |
| 5,984,629 | A * | 11/1999 | Brodersen et al. | 415/172.1 |
| 6,193,462 | B1 * | 2/2001 | Kubota | 415/106 |
| 7,600,961 | B2 * | 10/2009 | Abdallah | 415/1 |
| 7,997,854 | B2 * | 8/2011 | LaRose et al. | 415/106 |
| 8,021,104 | B2 * | 9/2011 | Gu et al. | 415/56.5 |
| 8,287,233 | B2 * | 10/2012 | Chen | 415/58.4 |
| 2002/0192073 | A1 * | 12/2002 | Japikse | 415/169.1 |
| 2006/0251808 | A1 * | 11/2006 | Kamo et al. | 427/230 |

* cited by examiner

CENTRIFUGAL PUMP HAVING AN APPARATUS FOR THE REMOVAL OF PARTICLES

CROSS REFERENCE TO RELATED APPLICATIONS

This application is a National Stage of International Application No. PCT/EP2009/067619 filed Dec. 21, 2009, and which claims the benefit of European Patent Application No. 09150312.8, filed Jan. 9, 2009, the disclosures of which are incorporated herein by reference.

The invention relates to a centrifugal pump having an apparatus for the removal of particles. This centrifugal pump should in particular be used for fluids which contain particles, with the particles being conveyed with the fluid.

A sand pump or a wastewater pump is known from DE 2344576 for which a solution is shown to pump a liquid containing abrasive components and in so doing to avoid that these abrasive components enter into the gap between the impeller and the housing of the rotary (radial) pump. Due to the pressure drop between the exit opening of the impeller and the suction side, the liquid flows through the gap between the housing and the impeller. This secondary flow is generally unwanted since the efficiency of the pump falls when some of the liquid is not conveyed in accordance with the intended purpose into the outlet passage adjoining the outlet opening of the impeller. The gaps between the impeller and the housing, which are in communication with the suction region, should therefore be kept as small as possible. The gaps therefore contain sealing surfaces which are in particular made as labyrinths. If abrasive components move onto these sealing surfaces, these sealing surfaces wear fast and have to be replaced frequently.

If the sealing surfaces are made from wear-resistant material, the interval between two replacement procedures can admittedly be prolonged; however, the costs for the pump increase.

It is therefore proposed in DE 2344576 to provide a ring-shaped chamber at the outside of the impeller to liberate the liquid from the abrasive components in that the liquid is set into rotation by the movement of the impeller. The abrasive components are separated from the liquid in the ring-shaped chamber. The liquid is selectively also introduced into passages which are applied to the outer side of the impeller and rotate with the impeller. The liquid is hereby likewise set into rotation so that a pre-separation of heavy contaminants can take place.

However, it is not shown what further happens to the separated contaminants; they therefore remain in the ring-shaped chamber and accumulate there. This accumulation of the contaminants can ultimately have a disadvantageous effect on the operation of the pump. On the one hand, deposits can form which change the flow relationships, clog up gaps and ultimately abrasive components can also move onto the sliding surfaces.

It is therefore the object of the invention to provide an apparatus by means of which a removal of particles takes place before the particles move onto the sliding surfaces between the impeller and the stator.

The solution contains a centrifugal pump which includes an apparatus for the removal of particles. The centrifugal pump includes an impeller, with a fluid being able to be conveyed by means of the impeller through a suction passage from a suction stub to a pressure stub. The impeller is rotatable in a fixed-position stator, with a gap being arranged between the stator and the impeller. The gap opens into a storage space for particles, with the storage space being in communication with the suction passage via a return line running in the stator. A plurality of return lines can selectively also be provided. A plurality of return lines are advantageous to keep the flow path for the particles in the storage space as short as possible.

The particles are thus led out of the storage space through the return line. The second gap opens into the suction passage. The second gap has a substantially smaller gap width than the diameter of the return line at least section-wise so that the second gap sets a substantially larger resistance against the flow. The particles are thus carried into the main flow via the return line. The particles are in turn conveyed together with the main flow in the direction of the pressure stub by means of the impeller. Particles can thus not collect at any point of the pump in accordance with the solution in accordance with the invention.

The flow in the return line is maintained by the pressure difference between the storage space and the suction passage.

The stator includes a fluid collection element and a stator element, with the return line running through the stator element. The fluid collection element as well as the stator element are of fixed-position, that is the flow is not accelerated either in the gap, or in the storage space, or in the return line, in contrast to the prior art, as in DE 2344576, for example.

This further advantage with respect to the prior art allows the removal of the particles from the storage space via the return line.

The return line runs through the fluid collection element when the storage space is arranged on the side of the stator remote from the suction passage.

In accordance with a further embodiment, the centrifugal pump, which has an apparatus for the removal of particles, includes a first stage and a second stage, with the first stage including a first impeller. A fluid can be conveyed by the first impeller through a first suction passage from a suction stub to the second stage. The first impeller is rotatable in a first stator. The second stage includes a second impeller. The fluid can be conveyed by the second impeller through a second suction passage from the first stage to a pressure stub. The second impeller is rotatable in a second stator, with a gap being arranged between the second stator and the impeller. The gap opens into a storage space for particles. The storage space communicates with the second suction passage via a return line running in the second stator.

In accordance with a further particularly preferred embodiment, the centrifugal pump includes at least one third stage. The third stage includes a third impeller. The fluid can be conveyed by the third impeller through a third suction passage from the second stage to a pressure stub. The third impeller is rotatable in a third stator, with a gap being arranged between the third stator and the impeller. The gap opens into a storage space for particles, with the storage space being in communication with the third suction passage via a return line running through the third stator.

The apparatus for the removal of particles can thus be used in multistage centrifugal pumps. Such a gap can lead from every stage into the suction passage which leads from a preceding stage to the impeller of the stage under consideration. An apparatus for the removal of particles can thus be provided in every stage.

The stator preferably includes a fluid collection element and a stator element as has been described above for the single-stage centrifugal pump.

With a multistage centrifugal pump, the last stage has a first storage space on a first side of the fluid collection element and a second storage space on the oppositely disposed side of the fluid collection element.

In accordance with a further embodiment, the first impeller and the second impeller of the centrifugal pump have a mirror-image arrangement with respect to a plane standing normal to the pump axis.

The second suction passage in particular has an outer passage section which is arranged outside the second stator as well as a communication passage for the connection of the outer passage section to a passage piece which leads to the suction side of the second impeller. A gap which is arranged between the second stator and a deflection element rotatable with the pump shaft leads away from the communication passage, with the gap opening into a storage space from which a return line branches which runs in the stator or in the housing and opens into the communication passage.

A third stage can be arranged between the first stage and the second stage or a plurality of stages can be arranged.

The gap in accordance with one of the preceding embodiments opens into a ring-shaped collection passage and the return line has a line section which is arranged tangentially to the ring-shaped collection passage and adjoins the ring-shaped collection passage. A plurality of line sections can also be provided. The line section preferably opens tangentially, that is in the direction of an imaginary tangent which is placed at the circular cross-section of the cylindrical jacket of the collection passage. An improved removal of the particles which collect along the cylindrical jacket takes place by this tangential arrangement of the line section which leads away from the collection passage. The particles are conveyed from the centrifugal flow to the wall of the jacket and are thus at the highest concentration in the region close to the wall. They are moved along with the peripheral flow in the collection passage. When the particles reach the inlet opening of the line section, they are deflected into the line section. If the line section is arranged tangentially to the collection passage, the deflection takes place gradually and not abruptly over an edge, as in the case of a line section which leads away from the collection passage in the radial direction. This gradual, edge-free deflection has the particular advantage that no flow separation can occur. Otherwise, in particular at high flow speeds, a separation of the flow and a formation of a vortex can occur along a sharp edge. Particles can be guided back into the flow by the formation of such a vortex, that is they remain longer than necessary in the flow in the collection passage. Due to the increased dwell time of the particles in the flow in the collection passage, the abrasion in the case of a radially arranged line section can be higher than for a tangentially arranged line section.

The line section tapers in the direction of flow of the fluid; the tapering is in particular conical. This means that the inlet cross-section normal to the flow direction is larger than the cross-section of the line section which adjoins the return line upstream. The cross-section of the line section decreases continuously at least over a part of its length. If the cross-section is circular, the extent of the cross-section in the conical part of the line section is conical.

Such a conical line section has the advantage that the flow at the inlet cross-section is delayed so that an increased share of particles can be removed with the flow into the line section.

The line section can be made as a groove, in particular when the groove is arranged in a ring element which is connected to the stator. Such a groove is easier to produce than a conical bore in the fluid collection element and therefore has cost benefits. In addition, the ring element could be replaced in the event of wear in the groove. The fluid collection element could in this case continue to be used because the delay of the flow takes place in the groove, in particular when it is made conical, as described above.

The line section has an axis which spans a plane with a radial line, with the plane including an angle to a radial plane. Starting from the pump axis, the radial line passes through the point of intersection of the axis with the cross-sectional surface of the inlet opening and is normal to the pump axis. In accordance with this embodiment, the line section has an angle to a normal plane including the radial line on the pump axis. This arrangement has the advantage that the transition from the line section into the return line takes place over an oblique angle, that is an angle of more than 90°. The flow in the line section and in the return line is hereby additionally calmed. In this case, a deposition of particles is also not to be anticipated in the kink which is present between the line section and the return line since no dead zones arise in the kink region in which backflows could form and in which a collection of particles could occur.

The line section advantageously has a coating, whereby the dimensional stability of the line section is increased. Otherwise, in particular in the inlet region of the flow in the line section, abrasion and an expansion of the cross-section due to material removal by the abrasive particles occur. The expansion of the cross-section can be greatly delayed by means of a coating of a coating material which is applied to the inner surface of the line section. The coating material contains a hard material, preferably a ceramic material, in particular tungsten carbide or silicon carbide.

The coating can preferably include a sleeve which contains a coating material, with the sleeve being placed into the line section or into the return line. The sleeve can also be made over its full circumference from a coating material, can in particular contain a ceramic material. This particularly preferred variant has the additional advantage that, in the event of wear, only the sleeve has to be replaced, but not the fluid collection element and/or the stator element in which the line section and the return line run.

A second gap is formed between the impeller and the associated stator. Fluid which flows back into the suction passage due to the pressure difference is likewise located in this second gap. This second gap opens downstream of the return line into the suction passage leading to the impeller. This second gap is arranged substantially axially and is connected via s secondary passage to the storage space. This second gap as well as the second passage cannot be avoided since moving parts, that is in particular the impeller, have to be kept separate from stationary parts, that is in particular the stator, including the stator element or the fluid collection element.

Particles are preferably carried into the collection space by the flow because the pressure difference between the collection space and the opening of the return line into the suction passage is larger than the pressure difference between the collection space and the opening of the second gap into the suction passage. The pressure applied in the suction line in the region of the opening of the return line is thus smaller than the pressure in the region of the opening of the gap into the suction passage.

The cross-sectional surface of the return line amounts to a maximum of 1% of the cross-sectional surface of the pressure stub, preferably a maximum of 0.05%, particularly preferably a maximum of 0.025%. Because the return line thus only makes up a small portion of the cross-sectional surface of the pressure stub, the loss of efficiency is of no import in this case.

Figure 2B:
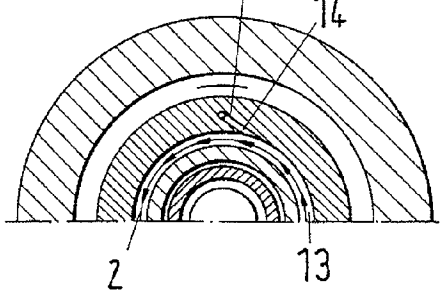
Figure 2A:
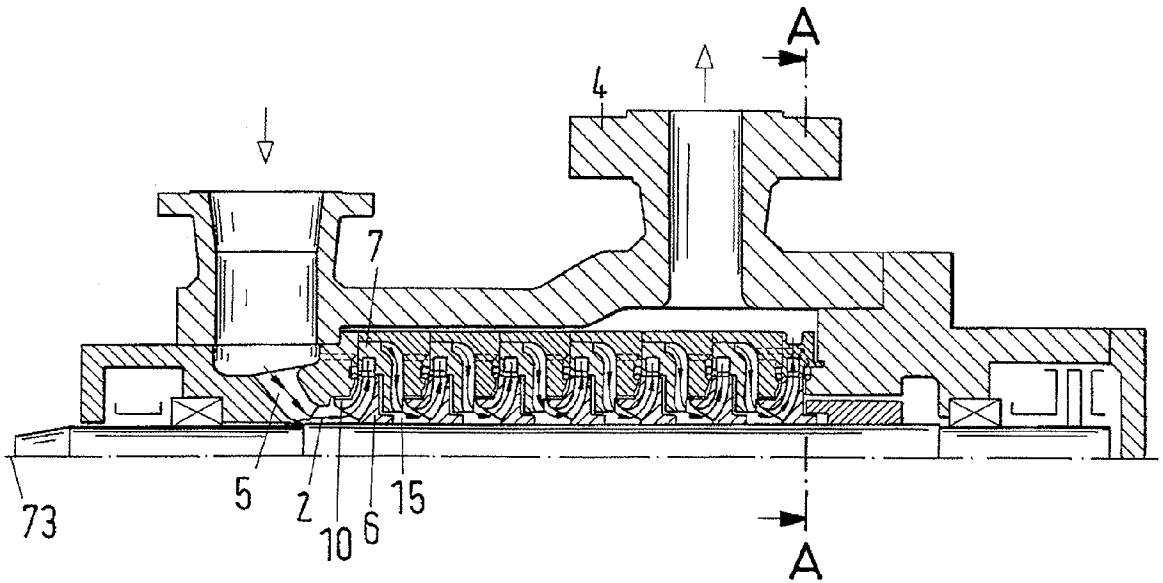
Figure 3B:
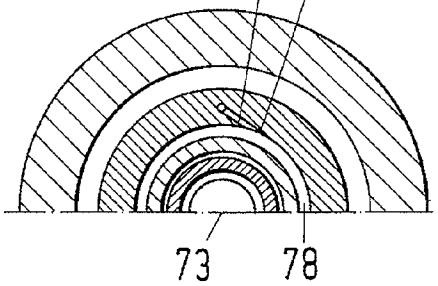
Figure 3A:
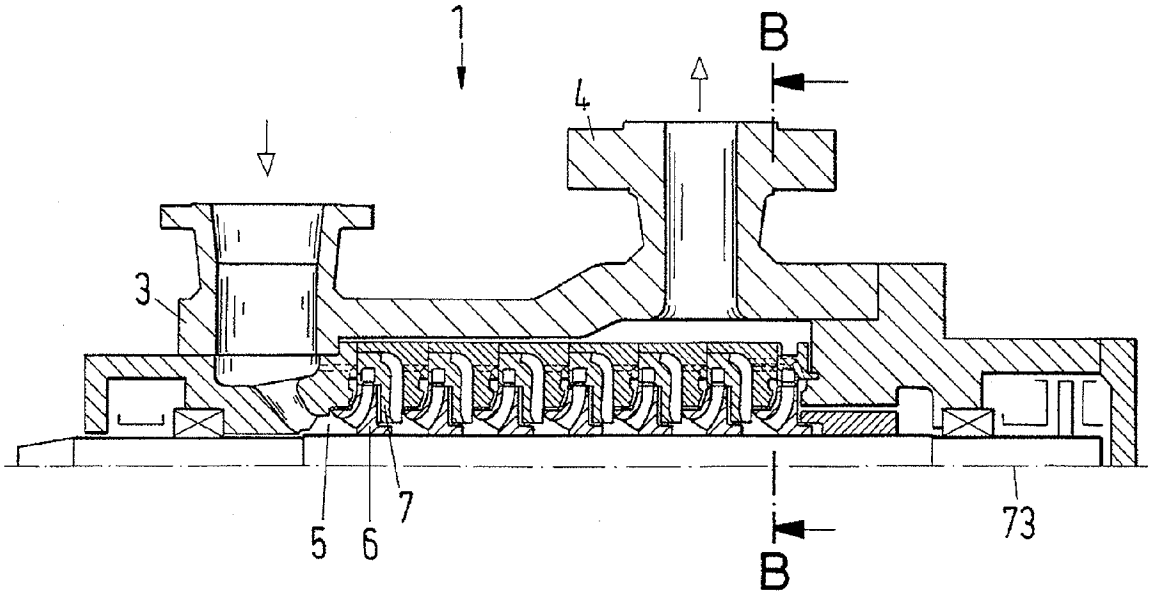

The invention will be explained in the following with reference to the drawings. There are shown:

FIG. 1 a section through a single-stage centrifugal pump in accordance with the invention;

FIG. 2*a* a section through a multistage centrifugal pump in accordance with the invention with indication of the extent of the flow;

FIG. 2*b* a section through a collection passage along the plane of FIG. 2*a* designated by reference symbols A-A;

FIG. 3*a* a section through a multistage centrifugal pump in accordance with the invention in accordance with the embodiment of FIG. 2*a;*

Figure 4:
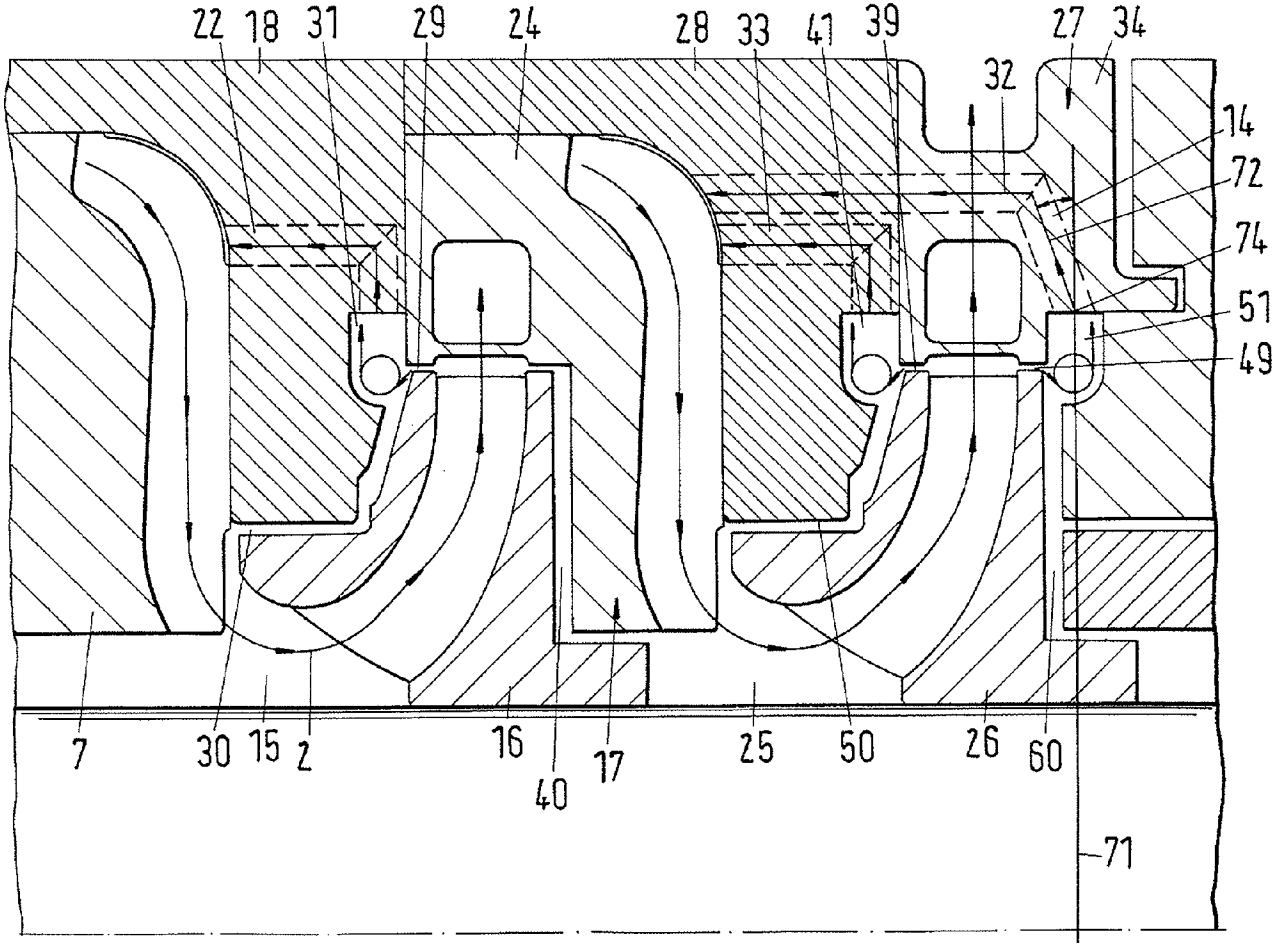

FIG. 3*b* a section through a collection passage along the plane of FIG. 3*a* designated by reference symbols B-B;

FIG. 4 a detail of a centrifugal pump of at least three stages in accordance with a detail of FIG. 2*a* or FIG. 3*a;*

Figure 5B:
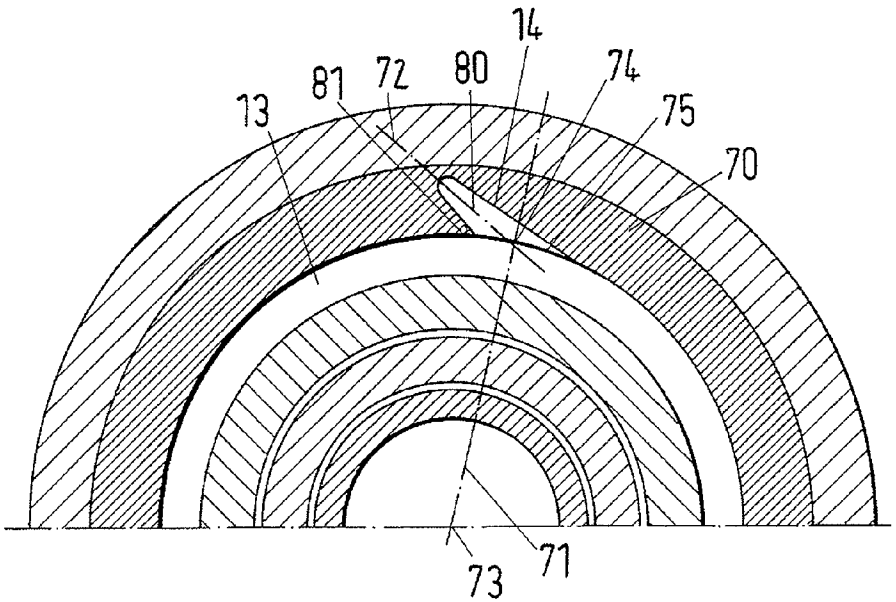
Figure 5A:
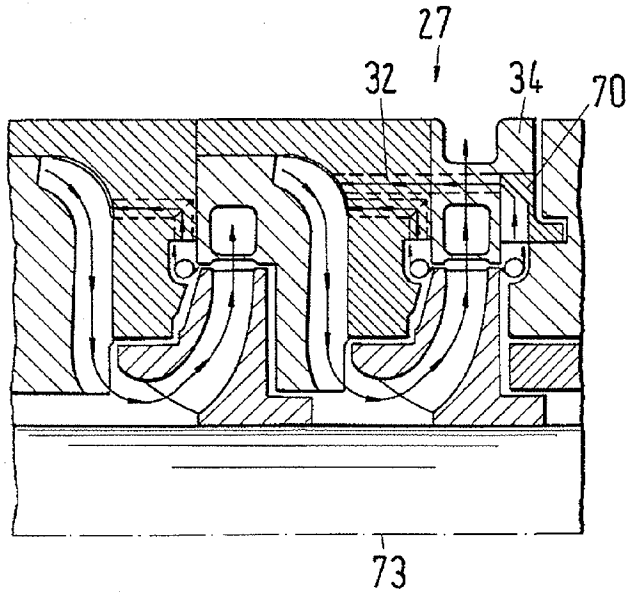
Figure 6:
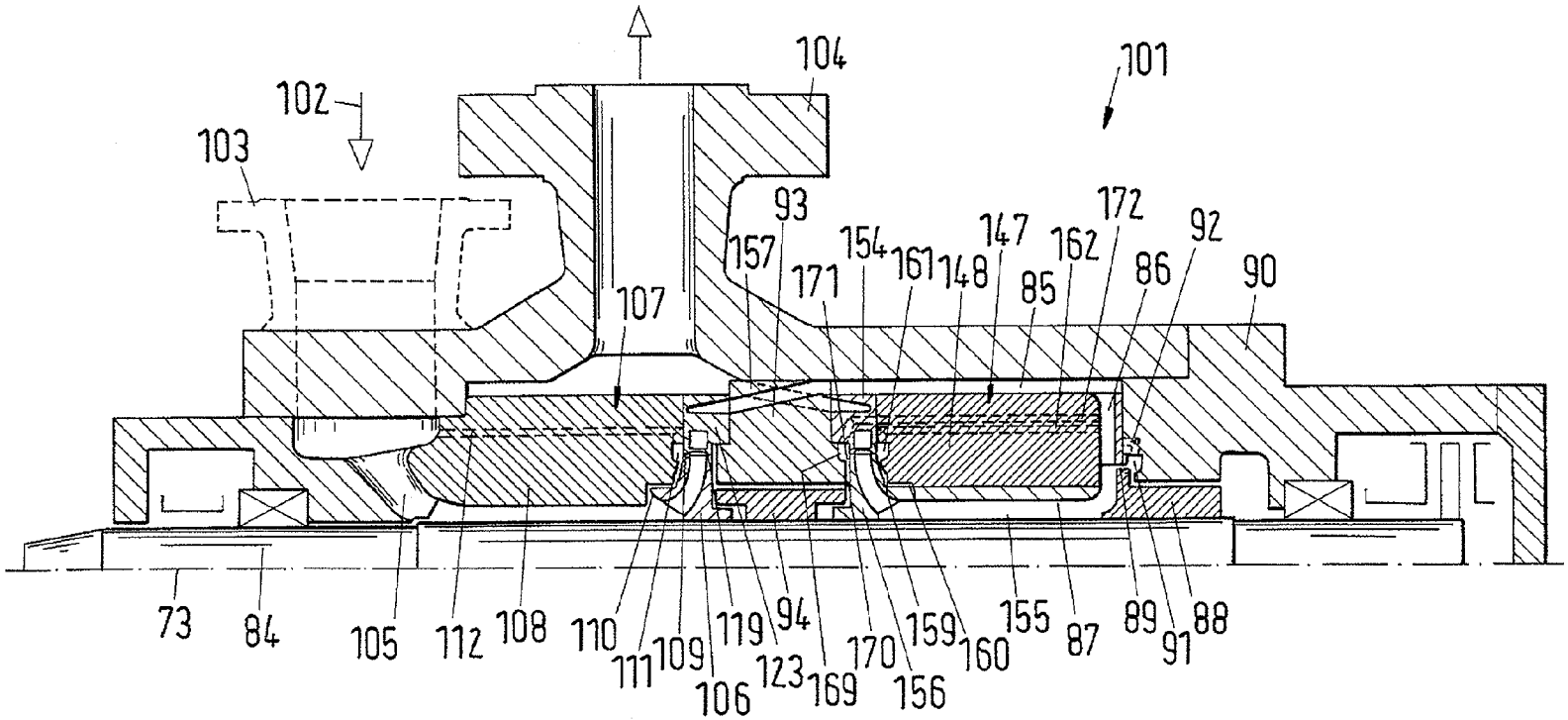
Figure 7:
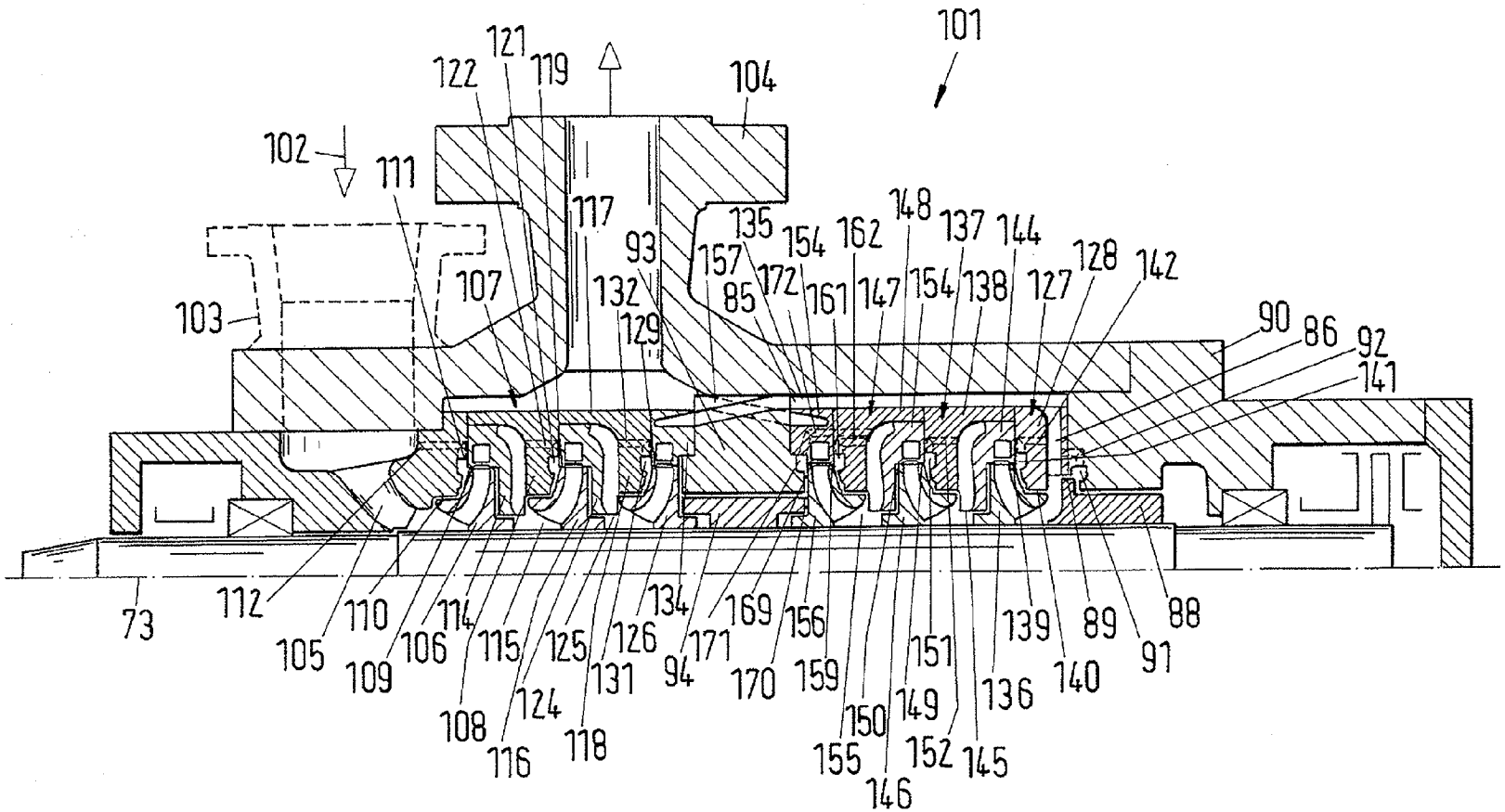
Figure 8:
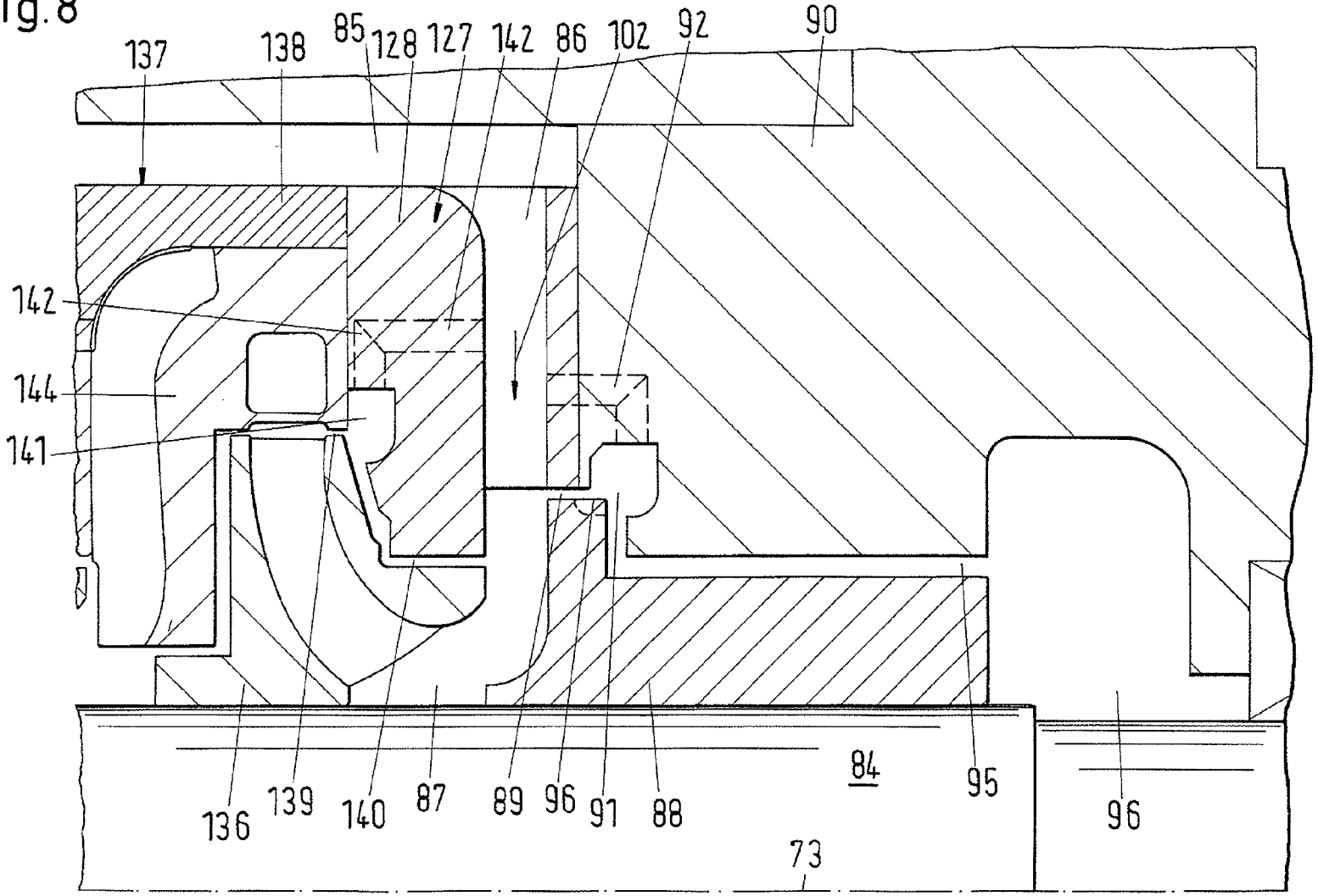

FIG. 5*a* a detail of a centrifugal pump of at least three stages in accordance with a detail of FIG. 2*a* or FIG. 3*a* in accordance with a further embodiment;

FIG. 5*b* a section through a collection passage along the plane of FIG. 5*a* designated by reference symbols C-C;

FIG. 6 a two-stage centrifugal pump in which two impellers are installed in a mirror-image arrangement, that is a back-to-back arrangement;

FIG. 7 a multistage centrifugal pump in accordance with the arrangement of FIG. 6;

FIG. 8 a detail of a centrifugal pump in accordance with FIG. 6 or FIG. 7.

FIG. 1 shows a single-stage centrifugal pump 1 which includes an apparatus for the removal of particles in accordance with the invention.

The centrifugal pump has an impeller 6 by means of which a fluid 2 can be conveyed through a suction passage 5 from a suction stub 3 to a pressure stub 4. The impeller 6 contains a hollow space into which the fluid originating from the suction passage 5 enters and is set into rotation when the impeller carries out a rotational movement about its axis. This axis will be called a pump axis in this text. The pump shaft to which the impeller 6 is rotationally fixedly connected lies on this axis. The pump shaft is connected to a drive motor, not shown, by means of which the pump shaft, and with it the impeller 6, can be set into a rotary movement. The impeller 6 is rotatable in a fixed-position stator 7. A gap 9, 19 is arranged between the stator 7 and the impeller 6 and thus separates the rotatable impeller 6 from the stator 7. The gap 9, 19 opens into a storage space 11, 21 for particles. The storage space 11, 21 is connected via a return line 12 running in the stator 7 to the suction passage 5. A plurality of return lines can be provided, in particular a plurality of return lines distributed over the ring-shaped storage space 11, 21.

The stator 7 can include a fluid collection element 23 and a stator element 8, with the return line running in the stator element 8 when the storage space 11 is located on the suction side of the impeller 6. A further storage space 21 can be arranged on the oppositely disposed side of the impeller 6. In this case, a line section of the return line leads through the fluid collection element 23 before it enters into the stator element 8 and runs in the stator element 8 in the direction of the opening to the suction passage 5.

FIG. 2*a* shows a section through a multistage centrifugal pump in accordance with a second embodiment of the invention. Like the single-stage centrifugal pump, the fluid 2 to be conveyed is sucked into the suction stub 3 and is conveyed to a pressure stub 4. The suction stub 3 can be connected to a container or tank, not shown. The centrifugal pump has a plurality of impellers 6 by means of which the fluid 2 is supplied from the suction passage 5, which starts at the suction stub 3, to the suction passage 15 of the next following stage. The suction passage 15 is the communication passage in which the fluid 2 is guided from the first stage to the second stage. This connection passage opens into inlet openings of the impeller 16. With respect to the impeller 16, the connection passage thus has the function of a suction passage; the term suction passage was therefore also selected for all the connection passages between individual stages of the multistage centrifugal pump.

The impeller 6 is guided rotatably in a stator 7. The impeller 6 contains a hollow space into which the fluid originating from the suction passage 5 enters and is set into rotation when the impeller carries out a rotary movement about its axis. For this purpose, vanes can be attached to the impeller 6 which force the fluid into a rotary movement. The impeller 6 is driven about the pump axis 73 via a drive shaft. When the fluid exits the impeller 6, it moves with the pulse gained by the rotary movement into a passage which belongs to the stator 7. The passage opens into the suction passage leading to the following stage or, if it is the last stage, to the pressure stub 4, so that the fluid can be conveyed from the last stage to a pressure stub 4. Each of the stages thus includes an impeller rotatably journaled about the pump axis, a stator as well as a suction passage. The suction passage opens into the conveyor space or spaces which are provided in the impeller and in which the fluid is received and set into rotation. The fluid is accelerated by the rotary movement, that is its kinetic energy is increased. The conveyor spaces in the impeller are preferably made in the manner of diffusers. The kinetic energy of the fluid is hereby converted into pressure energy so that there is an increase in the pressure while the fluid flows through the impeller. The fluid of high pressure exits the impeller and enters into a ring-shaped collection passage. The ring-shaped collection passage opens either into the suction passage of the following stage or into the pressure stub.

A gap 10, 20, 30, 40, 50, 60 is located between the impeller and the stator, which is also particularly clearly visible in FIG. 4. This gap is necessary to separate fixed-position parts such as the stator 7 from moving parts, that is from the impeller 6. If the gap 10 were not present, the impeller 6 would be exposed to high wear due to the friction-locking contact with the stator 7 and a permanent operation at high speed would not be possible. Pressure fluid moves through the gap 10 out of the collection passage 13 back into the suction passage 5. To keep the loss of efficiency caused by the gap 10 as low as possible, the gap 10 is kept as narrow as possible. In addition, gap seals forming a labyrinth could be provided as is shown in DE 2344576. Alternatively to this or as a supplement, points can be provided in the gap 10 at which a controlled wear takes place. These points are coated with temperature-resistant hard materials, for example ceramic materials, such as is shown in EP 1 116 886 A. The minimal gap width is achieved at these points. If particles reach such a point, contact of the two surfaces and abrasion and wear occur. The gap width must therefore be increased for a particle-charged fluid under the conditions prevailing in the stated prior art or the fluid must already be liberated from the particles.

The operation will be explained by way of example with reference to the first stage. The following stages differ in their function only such that the fluid is under increased pressure with respect to the previous stage.

FIG. 2*a* shows the course of the flow, which is shown by a line provided with arrows.

FIG. 2*b* shows a section through a collection passage 13 along the plane of FIG. 2*a* designated by reference symbols A-A; The section runs through the stator of the last stage. The reference numerals in accordance with FIG. 4 are used since they are not clearly visible enough in FIG. 2*a*. In FIG. 4, the stator of the last stage bears the reference numeral 27. It is made up of two parts, the fluid collection element 34 and the stator element 28. The section runs through the fluid collection element 34 precisely through the kink point at which the axis of the line section 14 merges into the axis of the return line 12. The section A-A then follows the axis of the line section 14 until the axis intersects the jacket of the collection passage 13. The section is then placed into a plane which stands normal on the pump axis 73 and contains the point of intersection of the axis of the line section 14 with the jacket of the collection passage 13. The flow direction of the fluid 2 is also marked by means of a line provided with arrows in this representation.

It is shown in this representation that the line section adjoins the jacket surface of the collection passage 13 tangentially in addition to its inclination with respect to the pump axis. Particles which flow in direct proximity to the jacket surface are taken up by this tangential inlet of the line section 14 and are directed into the line section so that the solids are separated from the flow of the fluid 2. The tangential inlet of the line section is located downstream of the ring flow which the fluid follows in the storage space. This means the ring flow in the storage space is defected on the entry into the tangential inlet of the line section from a circular path onto a substantially straight path or a path corresponding to the curvature of the line section if the line section has a curvature. It is advantageous if the transition from the ring flow to the flow in the line section takes place as gradually as possible; this means that abrupt deflections of the flow due to edges or elbows should in particular be avoided in the inlet of the line section. It also follows from this that the direction of rotation of the flow must be considered. The tangential component of the speed of the ring flow advantageously faces in the direction of the axis of the line section.

FIG. 3*a* shows a section through a multistage centrifugal pump in accordance with the invention in accordance with the embodiment of FIG. 2*a* which does not differ from FIG. 2*a* except for the position of the section B-B which is shown in FIG. 3*b*.

FIG. 3*b* thus shows a section through a collection passage 78 along the plane of FIG. 3*a* designated by reference symbols B-B. The collection passage 78 corresponds to the collection passage of FIG. 4 belonging to the storage space 41. The collection passage 78 extends in the stator element 28 of the stator 27 (corresponding reference numerals, see also FIG. 4). As can be seen from FIG. 3*b* in combination with FIG. 4, the section in this case is placed through the axis of the line section 79, with the line section 79 in turn tangentially adjoining the jacket surface of the collection passage 78. Unlike FIG. 2*b*, the axial inclination of the line section 79 is omitted in this case. An alignment of the line section in the direction of the pump axis is understood as the axial inclination. This means the axis of the line section is not arranged in a plane which stands normal on the pump axis, but rather in a plane which is inclined at an angle of less than 90° to the pump axis. Such a bore in a housing block as the stator element 28 represents is, however, more complex and/or expensive to manufacture from a technical production aspect and is preferably replaced where possible by a tangential bore, which is easier to manufacture, in a radial plane, that is in a plane standing normal to the pump axis 73 and containing the axis of the line section 79.

FIG. 4 shows a detail of a centrifugal pump of at least three stages in accordance with a detail of FIG. 2*a* or FIG. 3*a*. The centrifugal pump 1 includes an apparatus for the removal of particles. The centrifugal pump includes at least one first stage and one second stage, with the first stage including a first impeller 6. A fluid 2 can be conveyed by the first impeller 6 through a first suction passage 5 from a suction stub 3 to the second stage. The first impeller 6 is rotatable in a first fixed-position stator 7. The second stage includes a second impeller 16, with the fluid 2 being able to be conveyed by the second impeller 16 through a second suction passage 15 from the first stage to a pressure stub 4. The second impeller 16 is rotatable in a second fixed-position stator 17. A gap 29 is arranged between the second stator 17 and the impeller 16. The gap 29 opens into a storage space 31 for particles. The storage space 31 communicates with the second suction passage 15 via a return line 22 running in the second stator 17.

Furthermore, the centrifugal pump in accordance with FIG. 2*a* or FIG. 3*a* can include at least one third stage, with the third stage including a third impeller 26, with the fluid 2 being able to be conveyed by the third impeller 26 through a third suction passage 25 from the second stage to a pressure stub 4. The third impeller 26 is rotatable in a third fixed-position stator 27. A gap 39, 49 is arranged between the third stator 27 and the impeller 26. The gap 39, 49 opens into a storage space 41, 51 for particles. The storage space 41, 51 communicates with the third suction passage 25 via a return line 32, 33 running in the third stator 27.

The stator 17, 27 can include a fluid collection element 24, 34 and a stator element 18, 28, with the return line running through the stator element 18, 28 when the storage space 31, 41 is located on the suction side of the impeller 16, 26. The last stage has a first storage space 41 on a first side of the fluid collection element 24, 34 and a second storage space 51 on the oppositely disposed side of the fluid collection element 34. The storage space 41 is thus located at the suction side of the impeller 26; the storage space 51 on the oppositely disposed side of the impeller 26. In this case, a line section of the return line 32 leads through the fluid collection element 34 before it opens into the return line 32 which runs through the stator element 28.

The gap 9, 19, 29, 39, 49 includes a ring-shaped collection passage 13. The return line 12, 22, 32, 33 has a line section 14 which is preferably arranged tangentially to the ring-shaped collection passage 13.

The line section 14 can taper, in particular taper conically, in the flow direction of the fluid 2.

The line section 14 can be made as a groove 80.

FIG. 5*a* and FIG. 5*b* show a variant in which the fluid collection element 34 is made in multiple parts. The fluid collection element 34 includes a ring element 70. The ring element 70 is connected to the fluid collection element 34. In this case, the line section 14 can be made as a groove 80. The groove can be arranged in the ring element 70 which is connected to the stator 7. The use of the ring element 70 has a plurality of advantages. The ring element itself is simpler to produce since it is a turned part which is simple to make. Furthermore, the groove can be manufactured easily by milling. The groove can have any desired shape; it can be made conically, as is shown in FIG. 5*b*.

Alternatively to this, the axis of the line section could also be curved or have curved sections.

As a further advantage, it is also possible to replace the ring element 70 when traces of wear become noticeable. In particular the inlet section 81 converging to an acute angle is exposed to high abrasion in operation. If a ring element 70 is provided, a controlled wear thereof can be permitted and the ring element can be replaced within the framework of a planned service of the pump. The stator 27, in particular the fluid collection element 34, do not have to be replaced in this case and can continue to be used without restriction.

The line section 14 can have an axis 72 which spans a plane with a radial line 71, with the plane including an angle to a radial plane 77. Starting from the pump axis 73, the radial line passes through the point of intersection 74 of the axis 72 with the cross-sectional surface 75 of the inlet opening 76 and the radial plane 77 stands normal to the pump axis. Even a line section 14 inclined in two planes, that is double, can be manufactured more simply in a ring element 70. This double-inclined arrangement of the line section 14 avoids sharp-edged deflections of the fluid flowing through the line section. Such deflections can cause flow stall and local vortices can be formed downstream of the edge. If such vortices occur, dead zones can arise in the marginal regions disposed opposite the edge and particles can collect there which can impede the passage flow. In addition, the cross-section of the line section 14 and/or of the return line 12 which is flowed through is smaller so that the sucked out liquid volume becomes lower. In an extreme case, the line section could clog so that particles can enter into the gap 10 and the previously described damage can occur.

If a ring element with a groove 80 is used, the outlet of the line section 14 can likewise include an angle to a radial plane. A further calming of the flow can be initiated by means of the chamfer, which could alternatively also be made as a spherical surface segment, so that the previously described effects cannot occur at the transition to the return line 32.

The above statements naturally do not only apply to the line sections 14, 79 of the last stage, but rather to all line sections which can be provided in preceding stages which are, however, not provided with their own reference numerals for reasons of simplicity.

The line section 14, 79 can have a coating, whereby the effects of abrasive particles on the walls of the line section can be alleviated and the service life of the line section can be increased. The coating can in particular include a scratch-resistant hard material which is applied to the surface of the bore of the line section or a heat treatment which results in a hardening of the marginal layer.

In accordance with a particularly preferred embodiment, the coating can include a sleeve which contains a coating material, for example a ceramic material, in particular tungsten carbide, with the sleeve being placed into the line section 14, 79 or into the return line 12, 22, 32, 33. The sleeve can also be made up completely of coating material, in particular of a ceramic material. The use of a sleeve has the advantage that the coating of the sleeve can take place separately and that there is much less restriction in the selection of the coating process and of the coating material since the sleeve is coated before its installation. A coating or a sleeve including a coating can also be attached in the return line or lines 12, 22, 32, 33.

Particles can therefore be removed from the storage spaces 11, 21, 31, 41, 51 by means of the return lines 12, 22, 32, 33. A second gap 10, 20, 30, 40, 50, 60 which separates moving parts from fixed-position parts, as has been described above, is formed between the impeller and the associated stator. Because the particles enter into the line section of the return line from the storage space, the second gap 10, 20, 30, 50, 60 can be kept free of particles. The second gap can thus be made narrow, whereby the loss in efficiency is small. Installations can be provided in the gap which increase the flow resistance, for example, labyrinth-like elements or wear elements (not shown) can be arranged such as are known for applications for particle-free fluid flow. In addition, a high pressure loss is produced by the narrow second gap and the optionally provided installations so that only a small portion of the fluid 2 entering into the storage space is transported via the secondary passage to the second gap.

In addition, the second gap 10, 30, 50, 60 preferably opens downstream of the return line 12, 22, 32, 33 into the suction passage 5, 15, 25 leading to the impeller. However, it results from this that the pressure difference between the storage space 11, 21, 31, 41, 51 and the opening point of the return line in the associated suction passage is larger than the pressure difference between the same storage space and the opening point of the gap in the suction passage. In addition, the flow resistance on the path over the second gap 10, 30, 50 is larger than the flow resistance through the return lines 12, 22, 33. The same also applies to the flow resistance between the second gap 60 and the return line 32. The second gap 60 is formed between the balance piston and the housing. The pressure at the suction side is admittedly applied to the balance piston, that is the pressure difference is larger than the pressure difference between the suction passage 25 and the storage space 51. However, the flow resistance in the gap 60 can be increased so much by a sealing section, which includes a labyrinth or a wear element, for example, that a secondary flow of particle-charged fluid can be suppressed.

Due to the larger pressure difference and/or to the lower flow resistance, the particle-charged fluid is preferably guided from the storage space to the jacket surface of the associated collection passage 13 (not all collection passages have been provided with reference numerals, but the collection passages are equally present in the other storage spaces). The cross-sectional surface of the return line in particular amounts to a maximum of 1% of the cross-sectional surface of the pressure stub 4, preferably a maximum of 0.05%, particularly preferably a maximum of 0.025%. The cross-sectional surface of the return line is preferably larger than the cross-sectional surface of the gap. It can hereby be ensured that particles of all sizes, also particle agglomerates, enter through the line section (for example 14, 79) into the return line 12, 22, 32, 33. The gap can thus be kept free of particles.

FIG. 6 shows a two-stage centrifugal pump 101 in which two impellers are installed in a mirror-symmetrical arrangement, that is a back-to-back arrangement. In accordance with this embodiment, the first impeller 106 and the second impeller 156 of the centrifugal pump have a mirror-image arrangement with respect to a plane standing normal to the pump axis 73. The fluid 102 enters via the suction stub 103 into the suction passage 105 which leads to the first impeller 106 rotatably journaled on a pump shaft 84.

The fluid 102 can be conveyed by means of the impeller 106 through a suction passage 105 from the suction stub 103 to the pressure stub 104. The impeller 106 contains a hollow space into which the fluid originating from the suction passage 105 enters and is set into rotation when the impeller carries out a rotational movement about the pump axis 73. The pump shaft 84 is connected to a drive motor, not shown, by means of which the pump shaft 84, and with it the impeller 106, can be set into a rotary movement. The impeller 106 is rotatable in a fixed-position stator 107. The fluid 102 enters into a hollow space 106 and is accelerated by the impeller 106. The hollow space can expand in the manner of a diffuser in the impeller so that the speed of the fluid is at least partly converted into pressure energy, that is an increase in the pressure takes place in the region of the outlet openings of the impeller. The fluid 102 is introduced into a passage which is located in a fixed-position fluid collection element 123. The fluid collection element 123 is a part of the stator 107. The fluid located in the passage is introduced through a transition piece 93 into an outer passage section 85 which is part of the suction passage 115 which leads to the second stage.

A gap 109 is located between the stator 107 and the impeller 106 and thus separates the rotatable impeller 106 from the stator 107. The gap 109 opens into a storage space 111 for particles. The storage space 111 communicates with the suction passage 105 via a return line 112 running in the stator 107. A plurality of return lines can be provided, in particular a plurality of return lines distributed over the ring-shaped storage space 111.

The second suction passage 155 in particular has an outer passage section 85 which is arranged outside the second stator 147 as well as a communication passage 86 for the connection of the outer passage section 85 to a passage piece 87 which leads to the suction side of the second impeller 156. The suction passage 155 has a special feature in this mirror-image arrangement which will be looked at in more detail in FIG. 8. This suction passage is in communication on the side remote from the impellers 106, 156 with a space which has a lower pressure and in which in particular that pressure substantially prevails which is applied in the suction stub 103.

The second impeller 156 is disposed on the oppositely disposed side of the transition piece 93 and is separated from the transition piece 93 by a gap. The transition piece 93 is of fixed position, that is it can be part of the housing 90 of the pump or it can be fixedly connected to the housing of the pump. The transition piece 93 is fit between the fluid collection element 123 of the first stage and the fluid collection element 154 of the second stage, with the fluid collection element 154 being disposed substantially in the mirrored position to the fluid collection element 123. A spacer element 94 which rotates with the pump shaft can be provided between the transition piece 93 and the pump shaft 84. The spacer element 94 is then also separated from the transition piece by a narrow gap.

The second stage thus includes the second impeller 156, with the fluid 102 being able to be conveyed by the second impeller 156 through the second suction passage 155 from the first stage to a pressure stub 104. The second impeller 156 is arranged rotatable in a second stator 147. The operation of the second impeller 156 corresponds to the operation of the first impeller 106, with the fluid being conveyed in a passage which is disposed in the fluid collection element 154 and which can in particular be made in ring shape. The impeller 156 and/or the passage can be made in the manner of a diffuser so that the speed of the fluid produced by means of the impeller 156 can be regained at least in part as pressure energy. A communication passage 157 which runs through the transition piece and which opens into the pressure stub 104 adjoins the passage.

A gap 159 is arranged between the second stator 147 and the impeller 156, with the gap 159 opening into a storage space 161 for particles. The storage space 161 communicates with the second suction passage 155 via a return line 162 running through the second stator 147. A further gap 169 is provided on the oppositely disposed side of the impeller 156. This gap 169 is disposed between the fluid collection element 154 and the impeller 156. The gap 169 opens into a storage space 171 which is bounded by the fluid collection element 154, by the impeller 156 as well as by the transition piece 93. Particles carried along with the fluid flow are carried in this storage space 171 and are removed via a return line 172. A second gap 170 continues from the storage space 171 between the impeller 156 and the transition piece 93. This second gap has a substantially smaller width than the return line 172 and can additionally be equipped with installations which increase the flow resistance such as a labyrinth-like structure which is not shown in any more detail in the drawing. This has the consequence that the particle-charged fluid flow is preferably guided back from the storage space 171 through the return line 172 into the suction passage 155.

FIG. 7 shows a multistage centrifugal pump in accordance with the arrangement of FIG. 6. A third stage can be arranged between the first stage and the second stage or a plurality of stages can be arranged. The number of stages on the side disposed more closely to the suction stub 103 is preferably the same as the number of stages on the oppositely disposed side of the transition piece 93.

FIG. 7 shows three stages between the suction stub 103 and the transition piece 93 as well as three stages in mirror-image arrangement which are arranged between the housing 90 and the transition piece 93. Reference is made to FIG. 6 for the description of the first stage. Components of the same type have the same reference numerals as in FIG. 6. The fluid collection element 114 of the first stage has a different structure than the fluid collection element 123 of FIG. 6 because it opens into the suction passage 115 which leads to a second stage which has the same structure as the first stage.

The fluid 102 can be conveyed by means of the second impeller 116 from the suction passage 115 to the suction passage 125 for the third stage leading away from the impeller 116. The impeller 116 contains a hollow space into which the fluid originating from the suction passage 115 enters and is set into rotation when the impeller carries out a rotary movement about the pump axis 73. The pump shaft 84 is connected to a drive motor, not shown, by means of which the pump shaft 84, and with it the impeller 116, can be set into a rotary movement. The impeller 116 is rotatable in a fixed-position stator 117. The fluid 102 enters into a hollow space of the impeller 116 and is accelerated by the impeller 116. The hollow space can expand in the manner of a diffuser in the impeller so that the speed of the fluid is at least partly converted into pressure energy, that is an increase in the pressure takes place in the region of the outlet openings of the impeller. The fluid 102 is introduced into the suction passage 125 which starts in the fixed-position fluid collection element 124. The fluid collection element 124 is a part of the stator 117.

A gap 119 is located between the stator 117 and the impeller 116 and thus separates the rotatable impeller 116 from the stator 117. The gap 119 opens into a storage space 121 for particles. The storage space 121 communicates with the suction passage 115 via a return line 122 running in the stator 107. A plurality of return lines can be provided, in particular a plurality of return lines distributed over the ring-shaped storage space 121.

A third stage adjoins the second stage. The fluid 102 can be conveyed by means of the impeller 126 from the suction passage 125 to the suction passage 135 which leads to a fourth stage. The impeller 126 contains a hollow space into which the fluid originating from the suction passage 125 enters and is set into rotation when the impeller carries out a rotational movement about the pump axis 73, with the operation corresponding to the two preceding stages. The fluid 102 is introduced into a passage which is located in a fixed-position fluid collection element 134. The fluid collection element 134 is a part of the stator 117. The fluid located in the passage is introduced through a transition piece 93 into an outer passage section 85 which is part of the suction passage 135 which leads to the fourth stage.

A gap 129 is located between the stator 117 and the impeller 126 and thus separates the rotatable impeller 126 from the stator 117. The gap 129 opens into a storage space 131 for particles. The storage space 131 communicates with the suction passage 125 via a return line 132 running in the stator 117. A plurality of return lines can be provided, in particular a plurality of return lines distributed over the ring-shaped storage space 131.

In FIG. 7, the fourth stage has an impeller 136 which is arranged in a mirror-image arrangement to the impellers 106, 116, 126 of the first three stages. The number of stages with impellers of the same orientation can naturally be as desired; FIG. 6 and FIG. 7 only show two of the possible embodiments. In FIG. 7, the third and fourth stages are thus arranged symmetrically about the transition piece 93 whose structure does not differ from the transition piece of FIG. 6.

Fifth and sixth stages adjoin the fourth stage. The fluid moves from the sixth stage via the communication passage 157 arranged in the transition piece 93 to the pressure stub 104.

The suction passage 135 in particular has an outer passage section 85 which is arranged outside the stators 127, 137, 147 as well as a communication passage 86 for the connection of the outer passage section 85 to a passage piece 87 which leads to the suction side of the fourth impeller 136.

The fluid 102 can be conveyed by means of the fourth impeller 136 from the suction passage 135 to the suction passage 145 for the fifth stage leading away from the impeller 136. The construction of the impeller 136 otherwise does not differ from the preceding impellers. The impeller 136 is rotatable in a fixed-position stator 127. The stator 127 has a different construction because it contains the communication passage 86 which is required to conduct the fluid 102 in this arrangement to the suction side of the impeller 136. The fluid 102 flows through the impeller 136 and is subsequently introduced into the suction passage 145 which starts in the fixed-position fluid collection element 144. The fluid collection element 144 is a part of the stator 137.

A gap 139 is located between the stator 127 and the impeller 136 and thus separates the rotatable impeller 136 from the stator 127. The gap 139 opens into a storage space 141 for particles. The storage space 141 communicates with the suction passage 135 via a return line 142 running in the stator 127. A plurality of return lines can be provided, in particular a plurality of return lines distributed over the ring-shaped storage space 141.

The suction passage 135 has a special feature in this mirror-image arrangement which will be looked at in more detail in FIG. 8. This suction passage is in communication on the side remote from the impellers 106, 126, 136, 146, 156 with a space which has a lower pressure and in which in particular that pressure substantially prevails which is applied in the suction stub 103.

The fluid 102 can be conveyed by means of the fifth impeller 146 from the suction passage 145 to the suction passage 155 for the sixth stage leading away from the impeller 146. The construction of the impeller 146 otherwise does not differ from the preceding impellers. The impeller 146 is rotatable in a fixed-position stator 147. The suction passage 155 starts in the fixed-position fluid collection element 154. The fluid collection element 154 is a part of the stator 147. The stator 147 is directly adjacent to the stator 137.

A gap 149 which separates the rotatable impeller 146 from the stator 147 to which the fluid collection element 154 belongs, is located between the fluid collection element 154 and the impeller 146. The gap 149 opens into a storage space 151 for particles. The storage space 151 communicates with the suction passage 145 via a return line 152 running in the stator 137. A plurality of return lines can be provided, in particular a plurality of return lines distributed over the ring-shaped storage space 151.

A sixth stage which forms the last stage of the multistage centrifugal pump adjoins the fifth stage.

The sixth impeller 156 is disposed on the oppositely disposed side of the transition piece 93 and is separated from the transition piece 93 by a gap. The transition piece 93 is of fixed position, that is it can be a part of the housing 90 of the pump or it can be fixedly connected to the housing of the pump. The transition piece 93 is fit between the fluid collection element 123 of the first stage and the fluid collection element 154 of the sixth stage, with the fluid collection element 154 being disposed substantially in the mirrored position to the fluid collection element 123. A spacer element 94 which rotates with the pump shaft can be provided between the transition piece 93 and the pump shaft 84. The spacer element 94 is then also separated from the transition piece 93 by a narrow gap.

The sixth stage thus includes the sixth impeller 156, with the fluid 102 being able to be conveyed by the sixth impeller 156 from the suction passage 155 from the first stage to a pressure stub 104. The sixth impeller 156 is rotatably arranged in the stator 147. The operation of the sixth impeller 156 corresponds to the operation of the preceding impellers, with the fluid being conveyed in a passage which is disposed in the fluid collection element 154 and which can in particular be made in ring shape. The impeller 156 and/or the passage can be made in the manner of a diffuser so that the speed of the fluid produced by means of the impeller 156 can be regained at least in part as pressure energy. A communication passage 157 which runs through the transition piece and which opens into the pressure stub 104 adjoins the passage.

A gap 159 is arranged between the stator 147 and the impeller 156, with the gap 159 opening into a storage space 161 for particles. The storage space 161 communicates with the second suction passage 155 via a return line 162 running through the stator 147. A further gap 169 is provided on the oppositely disposed side of the impeller 156. This gap 169 is disposed between the fluid collection element 154 and the impeller 156. The gap 169 opens into a storage space 171 which is bounded by the fluid collection element 154, by the impeller 156 as well as by the transition piece 93. Particles carried along with the fluid flow are carried in this storage space 171 and are removed via a return line 172. A second gap 170 continues from the storage space 171 between the impeller 156 and the transition piece 93. This second gap has a substantially smaller width than the return line 172 and can additionally be equipped with installations which increase the flow resistance such as a labyrinth-like structure which is not shown in any more detail in the drawing. This has the consequence that the particle-charged fluid flow is preferably guided back from the storage space 171 through the return line 172 into the suction passage 155.

FIG. 8 shows a detail of a centrifugal pump in accordance with FIG. 6 or FIG. 7. In the arrangement in accordance with FIG. 6 or FIG. 7, the necessity results of supplying the fluid 102 precompressed in the first stage or in the first part of the stages to the second stage or to the second part of the stages which are arranged in mirror-image form to the first stage or to the first part of the stages. For this purpose, the fluid is guided in the suction passage 155 (FIG. 6) or 135 (FIG. 7) to the corresponding impeller of the corresponding stage. FIG. 8 in this respect shows an enlarged detail which shows the fourth stage as well as a part of the suction passage which leads to the fourth stage. The detail shows a part of the outer passage section 85 of the suction passage 135, 155 which is arranged between a housing section not designated in any more detail and the stators 127, 137, 147. The outer passage section 85 merges into the communication passage 86 which leads through the stator 127. The communication passage 86 opens into a passage piece 87 which participates in the rotation of the pump shaft 84 about the pump axis 73. The passage piece 87 opens into the impeller 136 or 156 for the embodiment in accordance with FIG. 6.

A gap 89 leads away from the communication passage 86 and is arranged between the stator 127, 147 and a deflection element 88 rotatable with the pump shaft 73, with the gap 89 opening into a storage space 91 from which a return line 92 branches which runs in the stator 127, 147 or in the housing 90 and opens into the communication passage 86.

The deflection element 88 serves among other things to set the fluid 102 flowing through the communication passage 86 into rotation so that an ideal flow against the impeller 136 can take place. Furthermore, the deflection element can also satisfy the function of a balance element to achieve a pressure balance between the pressure of the fluid 102 in the communication passage 86 and the pressure of the fluid on the oppositely disposed side of the deflection element. The pressure of the fluid on this oppositely disposed side of the deflection element substantially corresponds to the suction pressure, that is to the pressure in the suction stub 3, 103 in accordance with FIG. 6 or FIG. 7. A narrow gap 95 is thus also provided adjoining the storage space 91 in this case.

Since the pressure in the communication passage 86 is higher than in the fluid space 96, the same problem results in this case with respect to the carrying out of the particles into the gap 95. This problem is solved in the same way as above in connection with the gaps located between the impellers and the stators. The fluid exiting through the gap 89 is directed into the storage space 91. The storage space as well as the transition into the return line 92 are preferably formed in the same way, as described in connection with FIG. 2*b*, FIG. 3*b* or FIG. 5*b*. In addition, a guide element 96 can be attached to the deflection element 88 by means of which a radial speed component is imparted to the fluid flowing through the gap 89. A fluid flow circulating in the storage space 91 is hereby produced. Any particles carried along with the fluid are guided in the direction of the outer wall region of the storage space 91 by this flow. The region of the storage space which takes up the largest spacing from the pump axis 73 is called the outer wall region.

In the gap 139, likewise shown for comparison, between the impeller 136 and the stator 127 or the fluid collection element 144 of the stator 127, this circulating flow of the fluid 102 which enters through the gap 139 is produced by the impeller 136 itself. The particles thus preferably collect at the outer periphery of the storage space 141 or 91. A collection passage is thus formed by the storage space 91, 141. A line section of the associated return line 92 opens into the collection passage whose design can correspond to FIGS. 2*b*, 3*b*, 5*b*.

This applies in another respect in the same manner to the return line 142 which likewise opens into the communication passage 86.

All the features described here in connection with a multistage centrifugal pump can naturally also be used for a single-stage centrifugal pump and vice versa. The centrifugal pump can in particular be made as a single-stage or multistage rotary (radial) pump.

The invention claimed is:

1. A pump, comprising:

a stator;

a suction conduit comprising a suction stub and a pressure stub, wherein the pressure stub is disposed downstream of the suction stub along a flow direction of the suction conduit;

an impeller, rotatably disposed within the stator, wherein the impeller is configured to convey a fluid through the suction conduit from the suction stub to the pressure stub;

a gap disposed between the stator and the impeller;

a storage space for particles, disposed in the stator, wherein the storage space is in fluid communication with the gap; and a return line, disposed in the stator, providing fluid communication between the storage space and the suction conduit, wherein the suction conduit is downstream of the storage space along a flow direction of the return line such that, in use, the particles are conveyed from the storage space to the suction conduit through the return line.

2. The pump of claim 1, wherein the stator comprises a fluid collection element and a stator element, wherein the return line is disposed at least partly in the stator element.

3. The pump of claim 2, wherein the return line extends into the fluid collection element such that the return line is disposed both in the stator element and in the fluid collection element.

4. The pump of claim 3, wherein the storage space is disposed on a first side of the fluid collection element, the pump further comprising a second storage space on a second side of the fluid collection element, wherein the second storage space is in fluid communication with the gap, and wherein the return line provides fluid communication between the second storage space and the suction conduit, wherein the suction conduit is downstream of the second storage space along the flow direction of the return line.

5. The pump of claim 1, wherein the gap comprises an annular collection passage and the return line comprises a line section tangential to the collection passage.

6. The pump of claim 5, wherein the line section has an axis which spans a plane with a radial line, wherein the plane defines an angle to a radial plane, wherein the radial line, starting from the pump axis, passes through a point of intersection of the axis with a cross-sectional surface of the inlet opening, and wherein the radial plane is normal to a pump axis.

7. The pump of claim 5, wherein the line section comprises a coating.

8. The pump of claim 7, wherein the coating comprises a sleeve which contains a coating material, wherein the sleeve is disposed in the line section or in the return line.

9. The pump of claim 1, wherein the return line is disposed entirely within the stator and comprises an upstream end within the stator and disposed at the storage space, a downstream end within the stator and disposed at the suction conduit, and an extent between the upstream end and the downstream end disposed within the stator.

10. The pump of claim 5, wherein the line section tapers in the flow direction of the suction conduit or is a groove disposed in a ring element connected to the stator.

11. A pump, comprising:

a first stage, comprising:

a first stator;

a first suction conduit comprising a suction stub and a first pressure stub, wherein the first pressure stub is disposed downstream of the suction stub along a flow direction of the first suction conduit;

a first impeller, rotatably disposed within the first stator, wherein the first impeller is configured to convey a fluid through the first suction conduit from the suction stub to the first pressure stub;

a first gap disposed between the first stator and the first impeller;

a first storage space for particles, disposed in the first stator, wherein the first storage space is in fluid communication with the first gap; and a first return line, disposed in the first stator, providing fluid communication between the first storage space and the first suction conduit, wherein the first suction conduit is downstream of the first storage space along a flow direction of the first return line such that, in use, the particles are conveyed from the first storage space to the first suction conduit through the first return line; and a second stage, comprising:

a second stator;

a second suction conduit comprising a second pressure stub, wherein the second pressure stub is disposed downstream of the first stage along a flow direction of the second suction conduit;

a second impeller rotatably disposed within the second stator, wherein the second impeller is configured to convey the fluid through the second suction conduit from the first stage to the second pressure stub;

a second gap disposed between the second stator and the second impeller;

a second storage space for the particles, disposed in the second stator, wherein the second storage space is in fluid communication with the second gap; and a second return line, disposed in the second stator, providing fluid communication between the second storage space and the second suction conduit, wherein the second suction conduit is downstream of the second storage space along a flow direction of the second return line such that, in use, the particles are conveyed from the second storage space to the second suction conduit through the second return line.

12. The pump of claim 11, further comprising at least one third stage, comprising:

a third stator;

a third suction conduit comprising a third pressure stub, wherein the third pressure stub is disposed downstream of the second stage along a flow direction of the third suction conduit;

a third impeller rotatably disposed within the third stator, wherein the third impeller is configured to convey the fluid through the third suction conduit from the second stage to the third pressure stub;

a third gap disposed between the third stator and the third impeller;

a third storage space for the particles, disposed in the third stator, wherein the third storage space is in fluid communication with the third gap; and a third return line, disposed in the third stator, providing fluid communication between the third storage space and the third suction conduit, wherein the third suction conduit is downstream of the third storage space along a flow direction of the third return line such that, in use, the particles are conveyed from the third storage space to the third suction conduit through the third return line.

13. The pump of claim 11, wherein the second stator comprises a fluid collection element and a stator element.

14. The pump of claim 11, wherein the first impeller and the second impeller are substantially mirror-image symmetric, with a plane of symmetry of the first impeller and the second impeller aligned normal to an axis of the pump.

15. The pump of claim 14, further comprising:

a passage piece which leads to an upstream side of the second impeller;

a deflection element which is rotatable with a pump shaft; wherein the second suction passage comprises:

an outer passage section disposed outside the second stator; and a communication passage, wherein the communication passage connects the outer passage section to the passage piece;

a third gap is disposed between the second stator and the deflection element, wherein the third gap leads away from the communication passage;

a third storage space, wherein the third gap opens into the third storage space; and a third return line, wherein the third return line branches from the third storage space and wherein the third return line opens into the communication passage.

16. The pump of claim 14, further comprising a third stage disposed between the first stage and the second stage.

17. A centrifugal pump, including an apparatus for the removal of particles, wherein the centrifugal pump includes an impeller, wherein a fluid can be conveyed by means of the impeller through a suction passage from a suction stub to a pressure stub, wherein the impeller is rotatable in a stator, wherein a gap is arranged between the stator and the impeller, wherein the gap opens into a storage space for particles, characterized in that the storage space is in communication with the suction passage via a return line running through the stator, wherein the gap includes a ring-shaped collection passage and the return line has a line section which is arranged tangentially to the ring-shaped collection passage, wherein the line section tapers, in particular tapers conically, in the flow direction of the fluid or is made as a groove which is arranged in a ring element which is connected to the stator.

* * * * *